US006058656A

United States Patent [19]

Bischof et al.

[11] Patent Number: 6,058,656

[45] Date of Patent: May 9, 2000

[54] MOVABLE WALL OR MOVABLE PARTITION SYSTEM HAVING A DRIVE GEAR FOR USE IN A GUIDE RAIL TO MOVE MOVABLE WALL OR MOVABLE PARTITION ELEMENTS, AND A DRIVE GEAR FOR USE IN A MOVABLE WALL OR MOVABLE PARTITION SYSTEM

[75] Inventors: Markus Bischof, Altenrhein; Stefan Rechsteiner, Staad, both of Switzerland

[73] Assignee: Dorma GmbH + Co. KG, Ennepetal, Germany

[21] Appl. No.: 09/225,770

[22] Filed: Jan. 5, 1999

Related U.S. Application Data

[63] Continuation-in-part of application No. PCT/EP98/02526, Apr. 29, 1998.

[30] Foreign Application Priority Data

May 7, 1997 [DE] Germany ..... 197 19 008

[51] Int. Cl.[7] ..... E05B 13/00

[52] U.S. Cl. ..... 49/409; 16/91; 16/106

[58] Field of Search ..... 49/409, 410, 425; 16/87 R, 87.6 R, 87.2, 91, 97, 87 B, 106

[56] References Cited

U.S. PATENT DOCUMENTS

| | | | |
|---|---|---|---|
| 1,931,796 | 10/1933 | Hoffman . | |
| 2,807,058 | 9/1957 | Morgan | 49/409 |
| 3,071,825 | 1/1963 | Ferris . | |
| 4,559,740 | 12/1985 | Tuchiya et al. | 16/106 X |
| 4,723,374 | 2/1988 | Peterson et al. | 49/404 |

FOREIGN PATENT DOCUMENTS

| | | | |
|---|---|---|---|
| 413881 | 2/1991 | European Pat. Off. | 49/409 |
| 0679788 | 11/1995 | European Pat. Off. . | |
| 1496751 | 10/1967 | France . | |
| 3148464 | 12/1982 | Germany . | |
| 4041925 | 3/1992 | Germany . | |
| 0570540 | 7/1945 | United Kingdom . | |
| 1076949 | 7/1967 | United Kingdom . | |

*Primary Examiner*—Jerry Redman
*Attorney, Agent, or Firm*—Nils H Ljungman & Associates

[57] ABSTRACT

A drive gear for a guide rail with a partition wall or similar device in a hanging bearing from the drive gear, whereby the drive gear has a carrying roller and two guiding rollers. The guiding rollers have a truncated vertical section and approach with their casing surface as close as possible to the carrying roller's casing surface while still maintaining a minor gap. The guiding rollers are supported in guiding roller receivers in a way that the gap between the guide rail, passing above the carrying roller and the guiding rollers, and the carrying roller and the guiding rollers respectively is approximately identical.

20 Claims, 2 Drawing Sheets

MOVABLE WALL OR MOVABLE PARTITION SYSTEM HAVING A DRIVE GEAR FOR USE IN A GUIDE RAIL TO MOVE MOVABLE WALL OR MOVABLE PARTITION ELEMENTS, AND A DRIVE GEAR FOR USE IN A MOVABLE WALL OR MOVABLE PARTITION SYSTEM

CONTINUING APPLICATION DATA

This application is a Continuation-In-Part application of International Application No. PCT/EP98/02526, filed on Apr. 29, 1998, which claims priority from Federal Republic of Germany Patent Application No. 197 19 008, filed on May 7, 1997. International Application No. PCT/EP98/02526 was pending as of the filing date of the above-cited application. The United States was an elected state in International Application No. PCT/EP98/02526.

BACKGROUND OF THE INVENTION

1. Field of the Invention

The present invention relates to a drive gear for a guide rail with a partition wall or similar device in a hanging bearing from the drive gear with a lateral guiding recess in the guide rail for the penetration of a drive gear's carrying roller receiver which drive gear presents a carrying roller with a horizontal axle and guiding rollers laterally conducted above the carrying roller's axle in the guide rail while rotatable around a vertical axle, whereas the center longitudinal axes of the guiding roller's axles are placed intersecting either centrally or nearly centrally with the carrying roller in a vertical plane and in the drive gear's running direction in each time one guiding roller is arranged in front of and one guiding roller is arranged behind the carrying roller.

The present invention further relates to a drive gear for a guide rail with a partition wall or similar device in a hanging bearing from the drive gear. The guide rail can have a lateral guiding recess to hold the drive gear's carrying roller receiver. The drive gear can have a carrying roller with a horizontal axle and guiding rollers. The guiding rollers can be laterally conducted above the carrying roller's axle in the guide rail. Each guiding roller can be rotatable around a corresponding vertical axle. The guiding rollers can be positioned so that the center longitudinal axes of the vertical axles are placed intersecting either centrally or nearly centrally with the carrying roller in a vertical plane and in the drive gear's running direction. One guiding roller can be placed on each side of the carrying roller along the carrying roller's path of movement in the guide rail.

2. Background Information

A drive gear species as discussed above has been published by European Patent No. 0 679 788 A1. Such drive gears generally serve to guide in hanging bearing partition walls like glass doors, wooden doors or similar devices, especially in cases when a majority of such partition walls in the one position have to fit together in true alignment in respect to a greater closed wall, while in their second position, e.g. virtually with opened glass or wooden wall, they have to be conducted into a parking position. For this purpose, the individual partition wall is ordinarily suspended from respectively two drive gears that are force guided in a correspondingly formed guide rail leading the drive gears in height and sidewise. The drive gears may be manually or power operated. Moreover, it is known to equip the drive gears with a suspension unit including carrying rollers that carry the partition wall on both sides and stay on corresponding running surfaces in the guide rail. Each carrying roller is assigned at least one guiding roller to conduct the drive gear laterally in the guide rail. In order to reverse this drive gear type for pivoting the partition wall in a parking position, additional slide devices are required in the area of the so-called turnout (German Patent No. 31 48 464 C2).

With another execution type of such drive gears and guide rails as already published by European Patent No. 0 679 788 A1, are put in use two parallel guide rails side by side, whereby respectively one drive gear assigned to one partition wall is guided in the one guide rail and the other drive gear is guided in the second adjoining guide rail. By changing the distance between both adjoining guide rails in the area of the so-called turnout, the partition wall is reversed by 90° into the parking position without requiring corresponding deflection elements or other devices.

With the before-mentioned guide rails and the assigned drive gears, it is generally desirable to dimension the guide rails and the drive gears as small as possible, for cost as well as for space saving reasons. Especially when looking in the running direction, the requirement exists to build the drive gears as short as possible in order to improve the curve-going.

With the drive gear species according to European Patent No. 0 679 788 A1, the guide rail includes, above and below the carrying roller respectively, carrying rollers, and a cross-piece to which respectively at the upper part and underneath connects a canal built by the guide rail, in which canal are guided the drive gear's superior and inferior guiding rollers. Moreover, when looking in the running direction, respectively above and below the carrying roller, two guiding rollers are installed one after the other. The resulting drive gear's length, when looking in the running direction, considerably impairs the curve-going.

According to another execution example of the before-mentioned patent application, the complete guide rail is surrounded by a bow-shaped plate, on which plate's free ends are arranged the guiding rollers which thus are guided on the exterior side at the guide rail.

This construction also impairs the curve-going because of the important drive gear's overall width. Furthermore, the guide rail and the drive gear have to be dimensioned relatively high building, that means the clear headroom is simultaneously reduced.

OBJECT OF THE INVENTION

Based on a drive gear species as mentioned in the beginning, the present invention should solve the problem and design the drive gear's dimensions as well to the height as to the width as small as possible, especially however create a drive gear as short as possible when looking in the running direction.

That is to say, in one possible embodiment of the present invention, the object of the present invention can be to make a drive gear according to a drive gear species of the known art that can solve the problem of designing the drive gear so that its heighth and width dimensions are as small as possible, especially for creating a drive gear that can be substantially shorter than a drive gear of the known art when viewed in the direction in which it would run along a guiding structure.

SUMMARY OF THE INVENTION

The present invention solves the given problem with a drive gear having guiding rollers which present a truncated vertical cross section. The guiding roller's casing surface can approach, while still maintaining a gap, as close as possible to the casing surface of the drive gear's carrying roller so that the guiding roller's casing surface can run almost tangentially with regard to the carrying roller's casing surface. The guiding rollers can be supported, when looking in the drive gear's running direction, in front of and behind the carrying roller in guiding roller receivers in a way that the gap is almost identical between the rail profile of a guide rail, passing above the carrying roller and the guiding rollers, and the carrying roller and the guiding rollers respectively. Accordingly exists the advantage that the guide rail's vertical axles present the shortest possible clearance from the carrying roller's horizontal axles, which fact is facilitated by the guiding roller's truncated form, as this step allows the guiding roller's truncated formed casing to approach close to the carrying roller's casing. Furthermore, the distance of the carrying roller's axle to the guiding rollers can be calculated in height so that the gap between the guiding rollers and the rail profile is almost identical to the gap between the carrying roller and the rail profile. This concept optimally utilizes the space built by the guide rail in which are led the carrying roller and the guiding rollers. The present invention achieves a compact drive gear's constructional style, which realizes, besides material saving for the guide rail, especially a good curve-going characteristic.

In further development of the present invention, it has been advantageous to locate the carrying roller's axle or shaft in a floating or cantilevered manner on a carrier plate that can be connected to a partition wall or similar device, whereby the carrying roller is spaced from the carrier plate according to one possible embodiment of the present invention by means of a distance sleeve between the carrier plate and the carrying roller.

The carrier plate serves according to one possible embodiment of the present invention substantially simultaneously to connect the guiding roller receivers for the guiding rollers whereby these guiding roller receivers are respectively arranged in the drive gear's running direction in front of and behind the carrying roller's axle and parallel to it.

According to another possible embodiment of the present invention, pocket holes are provided in the guiding roller receivers serving to receive the guiding roller axles in a way to approach with its casing surface while maintaining a certain gap, close to the carrying roller's casing surface.

That is to say, according to another possible embodiment of the present invention, pocket holes can be provided in the guiding roller receivers serving to receive the guiding roller axles. The pocket holes can be designed in a way to permit the casing surface of the guiding rollers to be placed close to the carrying roller's casing surface while still maintaining a certain gap between them.

The proper guiding roller receivers are led according to one possible embodiment of the present invention as far as in the area of the carrying roller's casing surface in order that they may overlap the carrying roller's casing surface with their free ends with a minor gap.

As to the before-mentioned curve-going reasons, only one carrying roller is put in use and therefore the carrying roller is relatively highly loaded. In further development of the present invention, it is proposed that the carrying roller's casing surface possess an anti-wear blinding or covering, whereby additionally, according to one possible embodiment of the present invention, the guide rail's running surface assigned to the carrying roller may also be equipped with an anti-wear blinding or covering or protection.

Corresponding procedure is proposed according to another possible embodiment of the present invention for the guiding rollers. As only two guiding rollers are put in use with a very small clearance one from the other, it turned out to be advantageous to also provide the guide rail's running surface assigned to the guiding rollers with an anti-wear protection.

As a result, the present invention designs a relatively highly chargeable drive gear in all six degrees of freedom that is small, feasible and, price-wise, advantageous.

The above discussed embodiments of the present invention will be described further hereinbelow with reference to the accompanying figures. When the word "invention" is used in this specification, the word "invention" includes "inventions," that is, the plural of "invention." By stating "invention," the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

Hereinafter the present invention is explained in detail on the basis of at least one possible embodiment represented by the following figures, wherein.

DESCRIPTION OF THE PREFERRED EMBODIMENT

Figure 1:
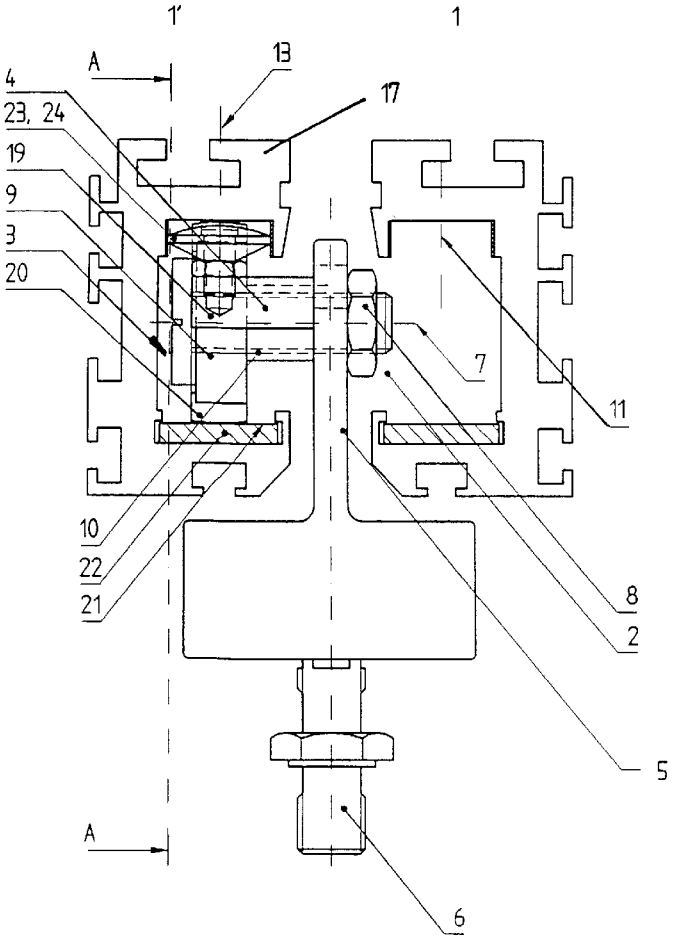
FIG. 1 shows a cross section of two adjoining guide rails together with the drive gear.

In FIG. 1 two adjoining guide rails referenced with 1 and 1' are connected in appropriate manner in the running guidance area, or they may be attached to a non-represented floor construction. In a parking position area, the guide rails 1 and 1' are laterally separated from each other like in a kind of turnout. In that case, it is to be assumed that two drive gears 3 are assigned to each nonrepresented partition wall (see FIG. 3); each first drive gear 3 being conducted in the guide rail 1 and each second drive gear 3 in the guide rail 1'.

The drive gear 3 penetrates a lateral rail's 1' guiding recess 2 and is attached by means of a carrier plate 5 and thereon connected rotatable shank 6 to a non-represented partition wall. A carrying roller receiver 4 for a carrying roller 9 consists basically of a carrying roller axle 7, a distance sleeve 10 arranged between the carrying roller 9 and the carrier plate 5, and a locknut 8 fixing the carrying roller axle 7 to the carrier plate 5. As FIG. 1 shows furthermore, the carrying roller 9 possesses an anti-wear blinding 20 rolling on a running surface 21, which running surface 21 is built by an anti-wear blinding 22 detachably embedded in the guide rail 1 or 1'. Guiding rollers 12 show a truncated form and roll with their casing surfaces 14' (see FIG. 2) on the guide rail's 1 running surfaces 23 which present according to FIG. 1 an anti-wear protection 24 embedded in the guide rail 1 or deposited on the guide rail 1. Moreover, FIG. 1 shows that the guiding roller's 12 center longitudinal axis 13 lies in a vertical plane intersecting the carrying roller 9 approximately in the middle.

Figure 2:
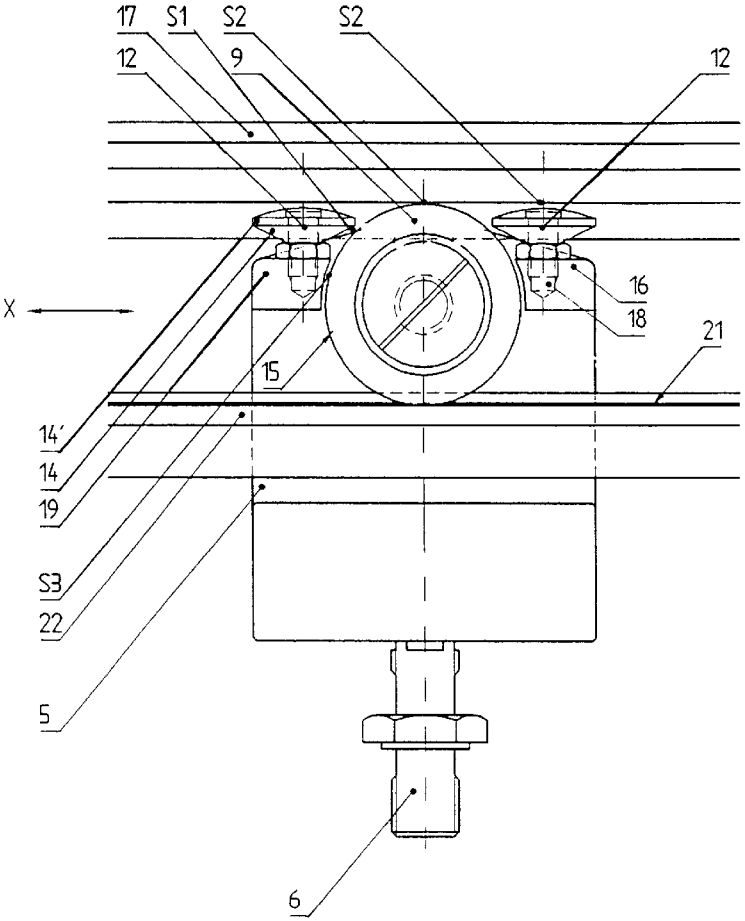
FIG. 2 shows a section according to line A—A as shown in FIG. 1.

FIG. 2 represents, when looking in the carrying roller's 9 running direction X, the directly adjoining guiding rollers 12. Axles 11 of the guiding roller 12 are installed in a guiding roller receiver's 16 pocket holes 18, whereas these pocket holes 18 are approximately placed in a free end area 19 of the guiding roller receivers 16. By this means the guiding rollers 12 may approach as close to the carrying roller 9 as possible so that only a minor gap S1 persists between the casing surface 14 of the guiding rollers 12 and the carrying roller's 9 casing surface 15, and a minor gap S3 persists between the guiding roller receiver 16 and the carrying roller's 9 casing surface 15.

Simultaneously, it comes to a mutual assignment of the guiding rollers 12 and the carrying roller 9 as to the height in that form that between the rail profile referenced with 17 and the guiding rollers 12 on the one hand as well as the carrying roller 9 on the other hand a gap referenced with S2 remains of approximately the same size.

In other words, according to one possible embodiment of the present invention, the guiding rollers 12 and the carrying roller 9 can be positioned with respect to the rail profile 17 so that a gap S2 of approximately similar size can exist between the guiding rollers 12 and the carrying roller 9 respectively.

Figure 3:
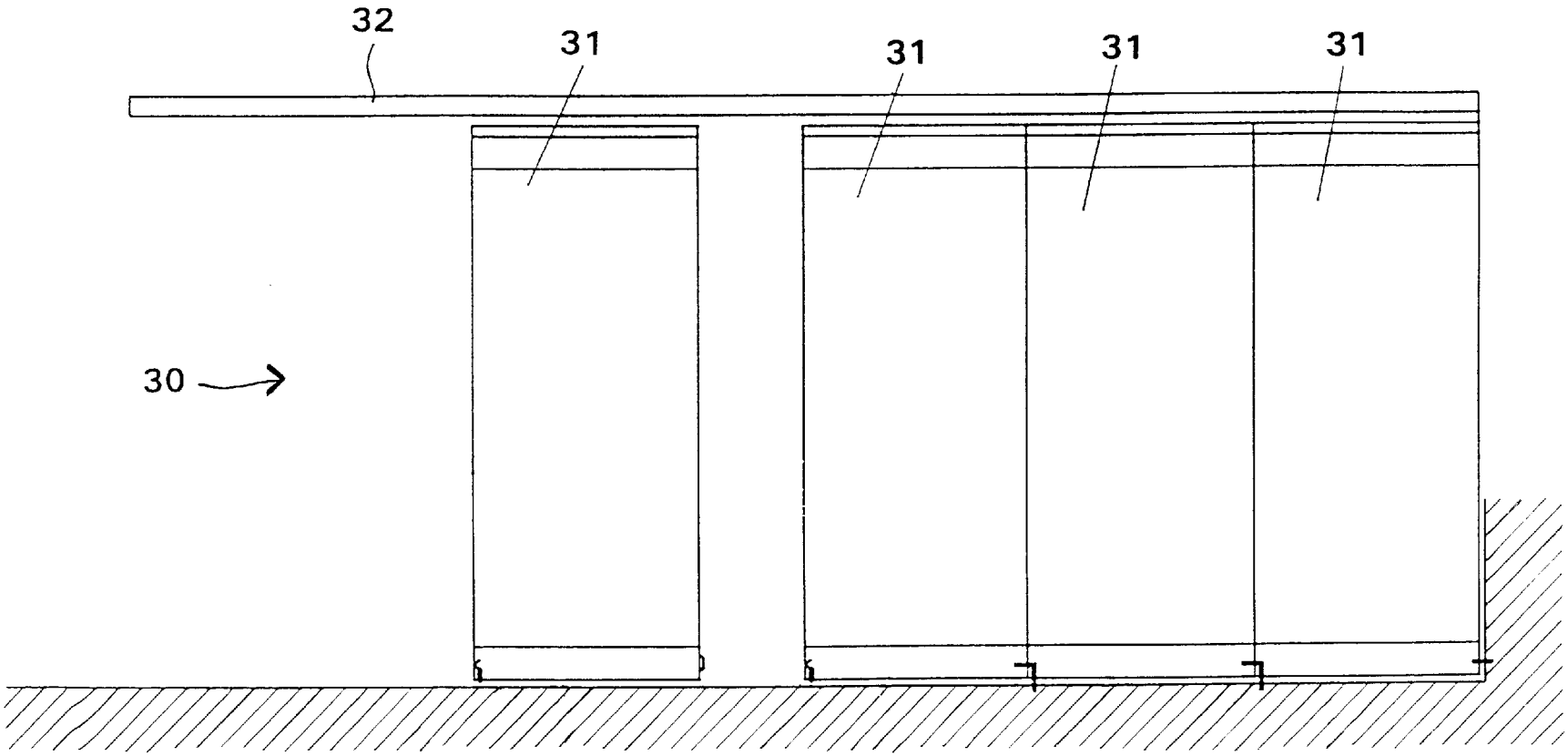
FIG. 3 shows one possible embodiment of the present invention having a movable partition system with partition elements.

FIG. 3 shows one possible embodiment of a movable wall or movable partition system in which the present invention could be used. A movable wall or movable partition system 30 is shown, which system can have hanging movable wall or movable partition elements 31. The hanging movable wall elements 31 can be hung from a corresponding drive gear 3 (as shown in FIG. 1) adjacent the ceiling area 32.

One feature of the invention resides broadly in the drive gear for a guide rail with a partition wall or similar device in a hanging bearing from a drive gear with a lateral guiding recess in the guide rail for the penetration of the drive gear's carrying roller receiver which drive gear presents a carrying roller with horizontal axle and guiding rollers laterally conducted in the guide rail above the carrying roller axle while rotatable around a vertical axle, whereby the center longitudinal axes of the guiding roller's axles are arranged intersecting centrally or nearly centrally the carrying roller in a vertical plane and in the drive gear's running direction is provided respectively one guiding roller in front of and one guiding roller behind the carrying roller, characterized by the following features: a) the guiding rollers 12 present a truncated vertical cross section and their casing surface 14 approaches while respecting a gap S1 as far as close to the carrying roller's 9 casing surface 15 so that the guiding roller's 12 casing surface 14 runs almost tangentially with regard to the carrying roller's 9 casing surface 15; b) the guiding rollers 12 are supported, when looking in the drive gear's 3 running direction (arrow X) in front of and behind the carrying roller 9, in guiding roller receivers 16 in a way that the gap S2 is almost identical between the rail profile 17, passing above the carrying roller 9 and the guiding rollers 12, and the carrying roller 9 respectively the guiding rollers 12.

Another feature of the invention resides broadly in the drive gear characterized in that the carrying roller's axle 7 is arranged floating at a carrier plate 5 connectable to the partition wall or similar device.

Yet another feature of the invention resides broadly in the drive gear characterized in that a distance sleeve 10 is provided between the carrier plate 5 and the carrying roller 9.

Still another feature of the invention resides broadly in the drive gear characterized in that guiding roller receivers 16 are placed on the carrier plate 5 in the drive gear's 3 running direction (arrow X) in front of and behind the carrying roller axle 7 and passing in parallel way to the latter.

A further feature of the invention resides broadly in the drive gear characterized in that the guiding roller receivers 16 present pocket holes 18 for the reception of the guiding roller axles 11.

Another feature of the invention resides broadly in the drive gear characterized in that the guiding roller receivers' 16 free ends 19 overlap the carrying roller's 9 casing surface 15 with a minor gap S3.

Yet another feature of the invention resides broadly in the drive gear characterized in that the carrying roller's 9 casing surface 15 presents an anti-wear blinding 20.

Still another feature of the invention resides broadly in the drive gear characterized in that the guide rail's 1, 1' running surface 21 assigned to the carrying roller 9 presents an anti-wear blinding 22.

A further feature of the invention resides broadly in the drive gear characterized in that the guide rail's 1, 1' running surfaces 23 assigned to the guiding rollers 12 present an anti-wear protection 24.

Some examples of foldable doors and mechanisms and devices for their operation which may be utilized or incorporated in an embodiment of the present invention may be found in the following U.S. Pats.: No. 5,186,230, issued to inventor Ostrander on Feb. 16, 1993; No. 4,932,455, issued to inventor Yamada on Jun. 12, 1990; and No. 5,099,903, issued to inventor Chen on Mar. 31, 1992.

Some examples of movable partition or wall systems and devices for their operation which may be utilized or incorporated in an embodiment of the present invention may be found in the following U.S. Pats.: No. 5,295,281, issued to inventor Kordes on Mar. 22, 1994; No. 5,394,648, issued to inventor Kordes on Mar. 7, 1995; No. 5,417,013, issued to inventor Tillman on May 23, 1995; No. 5,544,462, issued to inventor Kordes on Aug. 13, 1996; No. 5,406,761, issued to inventors Hobbiebrunken, et al. on Apr. 18, 1995; No. 5,152,332, issued to inventor Siener on Oct. 6, 1992; and No. 5,042,555, issued to inventor Owens on Aug. 27, 1991.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 197 19 008, filed on May 7, 1997, having inventors Markus Bischof and Stefan Rechsteiner, and DE-OS 197 19 008 and DE-PS 197 19 008 and International Application No. PCT/EP98/02526, filed on Apr. 29, 1998, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A movable partition system, said system comprising:

a guide rail;

said guide rail comprising an upper portion disposed toward a ceiling structure and a lower portion disposed away from said ceiling structure;

a drive gear arrangement;

said drive gear arrangement being configured to run one of:

on said guide rail; and in said guide rail;

a partition element;

said drive gear arrangement comprising:

a structure to hang said partition element from said drive gear arrangement;

a carrying roller to operatively support the weight of said partition element;

said carrying roller having an axle about which said carrying roller rotates;

said carrying roller having a running surface to contact said lower portion of said guide rail;

guiding rollers;

each of said guiding rollers being configured and disposed to roll along said upper portion of said guide rail and to guide said carrying roller along the path of said guide rail;

each of said guiding rollers having a corresponding axle about which each of said guiding rollers rotates, said axle being disposed substantially transverse to said axle of said carrying roller;

each of said guiding rollers having a contact surface disposed around the circular circumference of each of said guiding rollers, which contact surface being disposed to contact said upper portion of said guide rail;

each of said guiding rollers having a first side surface being disposed on a side of each of said guiding rollers and being configured to radially extend from the central axis to said contact surface of each of said guiding rollers;

at least one of said guiding rollers being disposed on a first side of said carrying roller in the path of movement of said carrying roller along said guide rail;

at least one of said guiding rollers being disposed on a second side of said carrying roller opposite said first side in the path of movement of said carrying roller along said guide rail; and said first side surface of each of said at least one guiding rollers disposed on said first side and said second side of said carrying roller comprising a truncated conical surface, said truncated conical surface being configured and disposed to permit at least a portion of said truncated conical surface to lie substantially on a tangent to said running surface of said carrying roller.

2. The movable partition system according to claim 1, wherein:

each of said guiding rollers has a second side surface disposed opposite said first side surface of each of said guiding rollers;

said contact surface is disposed between said side surfaces of each of said guiding rollers;

said truncated conical surface of said first side surface comprises a base portion and a top portion;

said base portion is substantially wider than said top portion;

said top portion is disposed a distance from said contact surface; and said base portion is disposed between said top portion and said contact surface.

3. The movable partition system according to claim 2, wherein:

said carrying roller disposed adjacent said upper portion of said guide rail is configured and disposed to form a gap between said running surface of said carrying roller and said upper portion of said guide rail;

each of said guiding rollers disposed adjacent said upper portion of said guide rail is configured and disposed to form a gap between said second side surface of each of said guiding rollers and said upper portion of said guide rail; and said gap between said running surface of said carrying roller and said upper portion of said guide rail is substantially similar in size to said gap between said second side surface of each of said guiding rollers and said upper portion of said guide rail.

4. The movable partition system according to claim 3, wherein:

each of said guiding rollers disposed substantially immediately adjacent said carrying roller is configured and disposed to form a minimal gap between each of said guiding rollers and said carrying roller to minimize the length of said drive gear arrangement.

5. The movable partition system according to claim 4, wherein:

said hanging structure comprises a support plate;

said support plate is configured and disposed to be connected to said partition element;

said axle of said carrying roller is configured and disposed to be connected in a cantilevered manner to said support plate;

said drive gear arrangement comprises a distance bushing; and said distance bushing is disposed between said support plate and said carrying roller.

6. The movable partition system according to claim 5, wherein:

said first side surface is disposed to face said lower portion of said guide rail;

said base portion of said truncated conical surface of said first side surface is disposed immediately adjacent said contact surface;

said drive gear arrangement comprises mounting structures to mount said guiding rollers disposed on said first side and said second side of said carrying roller;

each of said mounting structures is connected to said support plate; and each of said mounting structures comprises holes to receive the axles of each of said guiding rollers.

7. The movable partition system according to claim 6, wherein:

said mounting structures are disposed immediately adjacent said carrying roller;

said mounting structures disposed immediately adjacent said carrying roller are disposed to form a small gap between said mounting structure and said carrying roller;

said running surface of said carrying roller comprises an anti-wear material;

said upper portion of said guide rail disposed to contact said guiding rollers comprises an anti-wear material; and said lower portion of said guide rail disposed to contact said carrying roller comprises an anti-wear material.

8. A movable wall system, said system comprising:

a guide rail;

said guide rail comprising an upper portion disposed toward a ceiling structure and a lower portion disposed away from said ceiling structure;

a drive gear arrangement;

said drive gear arrangement being configured to run one of:

on said guide rail; and in said guide rail;

a wall element;

said drive gear arrangement comprising:

a structure to hang said wall element from said drive gear arrangement;

a carrying roller to operatively support the weight of said wall element;

said carrying roller having an axle about which said carrying roller rotates;

said carrying roller having a running surface to contact said lower portion of said guide rail;

guiding rollers;

each of said guiding rollers being configured and disposed to roll along said upper portion of said guide rail and to guide said carrying roller along the path of said guide rail;

each of said guiding rollers having a corresponding axle about which each of said guiding rollers rotates, said axle being disposed substantially transverse to said axle of said carrying roller;

each of said guiding rollers having a contact surface disposed around the circular circumference of each of said guiding rollers, which contact surface being disposed to contact said upper portion of said guide rail;

each of said guiding rollers having a side surface being disposed on either side of each of said guiding rollers and being configured to radially extend from the central axis to said contact surface of each of said guiding rollers;

said carrying roller disposed immediately adjacent said upper portion of said guide rail being configured and disposed to form a gap between said running surface of said carrying roller and said upper portion of said guide rail;

each of said guiding rollers disposed immediately adjacent said upper portion of said guide rail being configured and disposed to form a gap between said side surface of each of said guiding rollers and said upper portion of said guide rail; and said gap between said running surface of said carrying roller and said upper portion of said guide rail immediately adjacent said carrying roller being substantially similar in size to said gap between said side surface of each of said guiding rollers and said upper portion of said guide rail immediately adjacent said side surface to minimize the height of said drive gear arrangement and to minimize the height of the guide rail.

9. The movable wall system according to claim 8, wherein:

at least one of said guiding rollers is disposed on a first side of said carrying roller in the path of movement of said carrying roller along said guide rail;

at least one of said guiding rollers is disposed on a second side of said carrying roller opposite said first side in the path of movement of said carrying roller along said guide rail; and said side surface of each of said at least one guiding rollers disposed on said first side and said second side of said carrying roller comprising a conical surface, said conical surface is configured and disposed to permit at least a portion of said conical surface to lie substantially on a tangent to said running surface of said carrying roller.

10. The movable wall system according to claim 9, wherein:

each of said guiding rollers disposed substantially immediately adjacent said carrying roller is configured and disposed to form a minimal gap between each of said guiding rollers and said carrying roller to minimize the length of said drive gear arrangement.

11. The movable wall system according to claim 10, wherein:

said hanging structure comprises a support plate;

said support plate is configured and disposed to be connected to said wall element;

said axle of said carrying roller is configured and disposed to be connected in a floating manner to said support plate;

said drive gear arrangement comprises a distance bushing; and said distance bushing is disposed between said support plate and said carrying roller.

12. The movable wall system according to claim 11, wherein:

said drive gear arrangement comprises mounting structures to mount said guiding rollers disposed on said first side and said second side of said carrying roller;

each of said mounting structures is connected to said support plate; and each of said mounting structures comprises holes to receive the axles of each of said guiding rollers.

13. The movable wall system according to claim 12, wherein:

said mounting structures are disposed immediately adjacent said carrying roller;

said mounting structures disposed immmediately adjacent said carrying roller are disposed to form a small gap between said mounting structure and said carrying roller;

said running surface of said carrying roller comprises an anti-wear material;

said upper portion of said guide rail disposed to contact said guiding rollers comprises an anti-wear material; and said lower portion of said guide rail disposed to contact said carrying roller comprises an anti-wear material.

14. A drive gear arrangement for a movable wall or movable partition system, which system comprises at least one wall element and a guide rail having an upper portion configured to be disposed toward a ceiling structure and a lower portion configured to be disposed away from a ceiling structure, said drive gear arrangement comprising:

a hanging structure;

said hanging structure being configured to hang at least one wall element a carrying roller;

said carrying roller being configured to operatively support the weight of at least one wall element;

said carrying roller being configured to run along a guide rail to permit movement of said drive gear arrangement;

said carrying roller having an axle about which said carrying roller rotates;

said carrying roller having a running surface being configured to contact a lower portion of a guide rail;

guiding rollers;

each of said guiding rollers being configured to roll along an upper portion of a guide rail and to guide said carrying roller along a path of a guide rail;

each of said guiding rollers having a corresponding axle about which each of said guiding rollers rotates, said axle being disposed substantially transverse to said axle of said carrying roller;

each of said guiding rollers having a contact surface disposed around the circular circumference of each of said guiding rollers, which contact surface being configured to be disposed to contact an upper portion of a guide rail;

each of said guiding rollers having a side surface being disposed on either side of each of said guiding rollers and being configured to radially extend from the central axis to said contact surface of each of said guiding rollers;

at least one of said guiding rollers, being disposed on a first side of said carrying roller, being configured to be disposed in the path of movement of said carrying roller along a guide rail;

at least one of said guiding rollers, being disposed on a second side of said carrying roller opposite said first side, being configured to be disposed in the path of movement of said carrying roller along a guide rail;

each of said guiding rollers disposed substantially immediately adjacent said carrying roller being disposed to form a minimal gap between each of said guiding rollers and said carrying roller to minimize the length of said drive gear arrangement, which length of said drive gear arrangement being minimized to permit minimization of the radii of curvature of a curved portion of a guide rail; and said side surface of each of said at least one guiding rollers disposed on said first side and said second side of said carrying roller comprising a conical surface, said conical surface being configured and disposed to permit at least a portion of said conical surface to lie essentially on a tangent to said running surface of said carrying roller.

15. The drive gear arrangement according to claim 14, wherein each of said guiding rollers comprising a conical surface is configured and disposed to rotate to permit all portions of said conical surface upon rotation to lie essentially on a tangent to said running surface of said carrying roller.

16. The drive gear arrangement according to claim 15, wherein:

said contact surface is disposed between said side surfaces of each of said guiding rollers;

said conical surface comprises a base portion and a top portion;

said base portion is substantially wider than said top portion;

said top portion is disposed a distance from said contact surface; and said base portion is disposed between said top portion and said contact surface.

17. The drive gear arrangement according to claim 16, wherein said base portion is disposed immediately adjacent said contact surface.

18. The drive gear arrangement according to claim 17, wherein:

said carrying roller configured to be disposed adjacent an upper portion of a guide rail is configured to be disposed to form a gap between said running surface of said carrying roller and an upper portion of a guide rail;

each of said guiding rollers configured to be disposed adjacent an upper portion of a guide rail is configured to be disposed to form a gap between said side surface of each of said guiding rollers and an upper portion of a guide rail; and said gap between said running surface of said carrying roller and an upper portion of a guide rail is substantially similar in size to said gap between said side surface of each of said guiding rollers and an upper portion of a guide rail.

19. The drive gear arrangement according to claim 18, wherein:

said hanging structure comprises a support plate;

said support plate is configured to be connected to a wall element;

said axle of said carrying roller is connected to said support plate in one of:

a floating manner; and a cantilevered manner;

said drive gear arrangement comprises a distance bushing;

said distance bushing is disposed between said support plate and said carrying roller; and said conical surface being configured to be disposed to face a lower portion of a guide rail.

20. The drive gear arrangement according to claim 19, wherein:

said drive gear arrangement comprises mounting structures to mount said guiding rollers disposed on said first side and said second side of said carrying roller;

each of said mounting structures is connected to said support plate;

each of said mounting structures comprises holes to receive the axles of each of said guiding rollers;

said mounting structures are disposed immediately adjacent said carrying roller to form a gap between said mounting structures and said carrying roller; and said running surface of said carrying roller comprises an anti-wear material.

* * * * *